US009115961B2

(12) United States Patent
Amick

(10) Patent No.: US 9,115,961 B2
(45) Date of Patent: Aug. 25, 2015

(54) CORROSION-INHIBITED PROJECTILES, AND SHOT SHELLS INCLUDING THE SAME

(71) Applicant: Amick Family Revocable Living Trust, Albany, OR (US)

(72) Inventor: Darryl D. Amick, Albany, OR (US)

(73) Assignee: Amick Family Revocable Living Trust, Albany, OR (US)

( * ) Notice: Subject to any disclaimer, the term of this patent is extended or adjusted under 35 U.S.C. 154(b) by 0 days.

(21) Appl. No.: 13/943,625

(22) Filed: Jul. 16, 2013

(65) Prior Publication Data

US 2014/0318403 A1 Oct. 30, 2014

Related U.S. Application Data

(60) Provisional application No. 61/741,429, filed on Jul. 19, 2012, provisional application No. 61/758,173, filed on Jan. 29, 2013.

(51) Int. Cl.

| | |
|---|---|
| ***F42B 7/04*** | (2006.01) |
| ***F42B 7/10*** | (2006.01) |
| ***F42B 12/74*** | (2006.01) |
| ***F42B 12/80*** | (2006.01) |

(52) U.S. Cl.

CPC . *F42B 7/046* (2013.01); *F42B 7/04* (2013.01); *F42B 7/10* (2013.01); *F42B 12/74* (2013.01); *F42B 12/80* (2013.01)

(58) Field of Classification Search

CPC ..... F42B 7/04; F42B 7/046; F42B 7/10; F42B 7/00; F42B 12/74; F42B 12/80

USPC ..... 102/450, 452, 453, 454, 460, 514, 515, 102/516

See application file for complete search history.

(56) References Cited

U.S. PATENT DOCUMENTS

| | | | | |
|---|---|---|---|---|
| 1,187,867 | A | 6/1916 | Shinkle | |
| 1,582,673 | A | 4/1926 | Fahrenwald | |
| 3,400,660 | A | 9/1968 | Malter | |
| 3,669,023 | A * | 6/1972 | Moehlman et al. | 102/453 |
| 4,035,116 | A | 7/1977 | O'Brien et al. | |
| 4,655,140 | A | 4/1987 | Schirneker | |
| 4,714,023 | A | 12/1987 | Brown | |
| 4,811,666 | A | 3/1989 | Lutfy | |
| 4,819,563 | A | 4/1989 | Bodet | |

(Continued)

FOREIGN PATENT DOCUMENTS

GB 2111176 * 6/1983

OTHER PUBLICATIONS

Olin Winchester Material Safety Data Sheet, Jan. 1, 2013.

(Continued)

*Primary Examiner* — Stephen M Johnson

(74) *Attorney, Agent, or Firm* — Dascenzo Intellectual Property Law, P.C.

(57) ABSTRACT

Corrosion-inhibited copper-containing projectiles and shot shells including the same. The projectiles include a core that is formed from a core material, and an outer coating that is formed from a coating material. The core material includes copper, and optionally may include at least 50 wt % copper. In some embodiments, the outer coating maintains a corrosion rate of copper within the core material below 0.00075 mmpy. The shot shells include a shot charge that includes a plurality of the projectiles.

30 Claims, 2 Drawing Sheets

(56) References Cited

U.S. PATENT DOCUMENTS

| | | | | |
|---|---|---|---|---|
| 4,949,644 | A | 8/1990 | Brown | |
| 5,131,123 | A | 7/1992 | Brooks | |
| 5,747,724 | A * | 5/1998 | Lindgren et al. | 102/459 |
| 5,811,723 | A | 9/1998 | Stone | |
| 6,070,532 | A | 6/2000 | Halverson | |
| 6,071,359 | A | 6/2000 | Wisniewski et al. | |
| 6,202,561 | B1 | 3/2001 | Head et al. | |
| 6,938,552 | B2 | 9/2005 | Tom et al. | |
| 7,108,741 | B2 * | 9/2006 | Yang et al. | 106/18.32 |
| 7,361,279 | B2 | 4/2008 | Hernandez et al. | |
| 8,122,832 | B1 * | 2/2012 | Wei | 102/501 |
| 2010/0037794 | A1 * | 2/2010 | Authement, Sr. | 102/459 |
| 2011/0203477 | A1 | 8/2011 | Amick | |
| 2011/0233473 | A1 * | 9/2011 | Fletcher | 252/389.1 |

OTHER PUBLICATIONS

Sanderson, Glen C. et al, *Toxicity of Ingested Bismuth Alloy in Game-farm Mallards*; Illinois Natural History Survey Bulletin. vol. 35, Articles 3 and 4. Apr. 1997.

Cochrane, Robert L., *Crippling Effects of Lead, Steel, and Copper Shot on Experimental Mallards*; Wildlife Monographs from the Journal of Wildlife Management. vol. 40, No. 4. Oct. 1976.

* cited by examiner

CORROSION-INHIBITED PROJECTILES, AND SHOT SHELLS INCLUDING THE SAME

RELATED APPLICATIONS

This application claims priority to U.S. Provisional Patent Application No. 61/741,429, which was filed on Jul. 19, 2012 and to U.S. Provisional Patent Application No. 61/758,173, which was filed on Jan. 29, 2013, the complete disclosures of which are hereby incorporated by reference.

FIELD OF THE DISCLOSURE

The present disclosure is directed generally to corrosion-inhibited projectiles, and more particularly to corrosion-inhibited copper-containing projectiles and/or to shot shells that include corrosion-inhibited copper-containing shot.

BACKGROUND OF THE DISCLOSURE

Historically, lead projectiles have been utilized with firearms. However, under certain conditions, environmental and/or wildlife regulations may preclude the use of lead as a projectile due to the toxicity thereof. As illustrative, non-exclusive examples, an animal might ingest the lead projectile, an animal that has been shot with a lead projectile might be consumed by another animal, and/or the lead might act as an environmental contaminant. Thus, alternative projectile materials have been pursued.

Steel, bismuth, tin, and/or tungsten-based projectiles all have been utilized, with limited success. However, each of these projectiles suffers from distinct disadvantages. As illustrative, non-exclusive examples, these projectiles may damage a barrel of a firearm, may not produce desired ballistic properties (such as a desired shot pattern, a desired shot velocity, a desired shot penetration, and/or a desired shot trail) when fired from a shotgun or other firearm, and/or may be expensive to manufacture compared to the expense to manufacture conventional lead projectiles. Thus, there exists a need for improved projectiles that may meet environmental and/or wildlife regulations regarding toxicity while also being economical to manufacture and/or while producing desired ballistic properties when fired from a shotgun or other firearm.

SUMMARY OF THE DISCLOSURE

Corrosion-inhibited copper-containing projectiles and shot shells including the same are disclosed herein. The projectiles include a core that is formed from a core material, and an outer coating that is formed from a coating material. The core material includes copper. The coating material is different from the core material and is selected to decrease a corrosion rate of the core material.

In some embodiments, the core includes at least 50 weight percent (wt %) copper. In some embodiments, a diameter of the projectile is at least 1 mm and less than 10 mm. In some embodiments, the projectile is a shot pellet that is sized to be placed within a shot shell.

In some embodiments, at least one of a thickness of the outer coating and a composition of the outer coating is selected to maintain a corrosion rate of the copper below a threshold copper corrosion rate of 0.00075 millimeters per year (mmpy). In some embodiments, the corrosion rate of the copper is determined when the copper is immersed in an aqueous solution that includes a chemical composition that is comparable to a chemical composition of a body of water into which the projectile is immersed subsequent to being fired from a firearm.

In some embodiments, the core is a composite core that includes an inner region and an outer region that encapsulates the inner region. In some embodiments, the outer region comprises copper. In some embodiments, the inner region comprises a copper alloy, brass, bronze, zinc, tin, phosphorus, aluminum, manganese, silicon, and/or mixtures and/or alloys thereof.

In some embodiments, the outer coating defines an outer shell that defines an inner volume that contains the core. In some embodiments, the outer coating defines a coating thickness of less than 0.05 mm. In some embodiments, the outer coating includes an isolation layer, a passivation layer, a corrosion-inhibiting layer, and/or a hydrophobic film. In some embodiments, the outer coating includes a plurality of layers. In some embodiments, the projectile further includes an adhesion layer that increases an adhesion between the core and the outer coating. In some embodiments, the adhesion layer forms a ligand with the core material.

In some embodiments, the outer coating includes a copper oxide, a copper sulfide, a copper sulfate, a copper carbonate, and/or a copper chloride. In some embodiments, the outer coating includes a paint, a varnish, a lacquer, an oil, and/or a wax. In some embodiments, the outer coating includes an azole, a thiazole, a benzothiazole, a triazole, a benzotriazole, a tolytriazole, a methylbenzotriazole, a carboxybenzotriazole, an ethylenediaminetetraacetic acid, a dimercaprol, a porphyrin, and/or potassium sorbate.

Shot shells according to the present disclosure may include a cylindrical casing that defines a head portion, a mouth region, and an enclosed volume. The shot shells further may include a primer that is operatively attached to the head portion and a propellant charge that is located within the enclosed volume proximal to the primer. The shot shells also include a shot charge that includes a plurality of the projectiles and may include a wad that is located within the enclosed volume and separates the shot charge from the propellant charge.

In some embodiments, the shot shell is configured to be fired from a firearm. In some embodiments, the outer coating is configured to remain at least partially intact subsequent to being fired from the firearm and striking a target. In some embodiments, the target includes a body of water and the outer coating is configured to maintain the corrosion rate of the copper below 0.00075 mmpy while the projectile is located within the body of water.

DETAILED DESCRIPTION AND BEST MODE OF THE DISCLOSURE

FIGS. 1-4 provide illustrative, non-exclusive examples of firearm projectiles 100 according to the present disclosure and/or of shot pellets 30 and/or shot shells 10 that may be, may include, and/or may utilize projectiles 100. Elements that serve a similar, or at least substantially similar, purpose are labeled with like numbers in each of FIGS. 1-4, and these elements may not be discussed in detail herein with reference to each of FIGS. 1-4. Similarly, all elements may not be labeled in each of FIGS. 1-4, but reference numbers associated therewith may be utilized herein for consistency. Elements, components, and/or features that are discussed herein with reference to one or more of FIGS. 1-4 may be included in and/or utilized with any of FIGS. 1-4 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
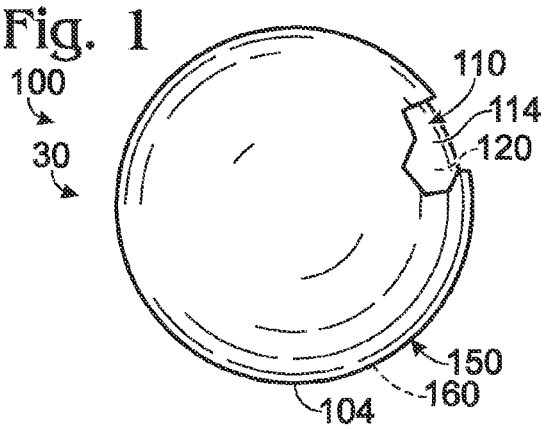
FIG. 1 is a partial fragmentary side view of an illustrative, non-exclusive example of a projectile according to the present disclosure.
Figure 2:
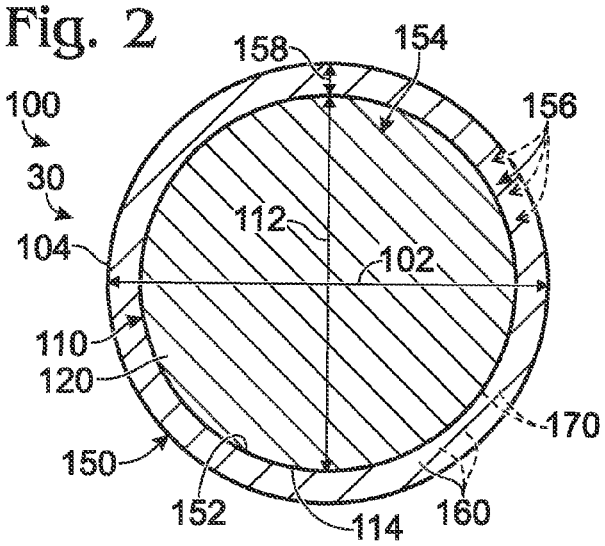
FIG. 2 is a schematic cross-sectional view of illustrative, non-exclusive examples of a projectile according to the present disclosure.
Figure 3:
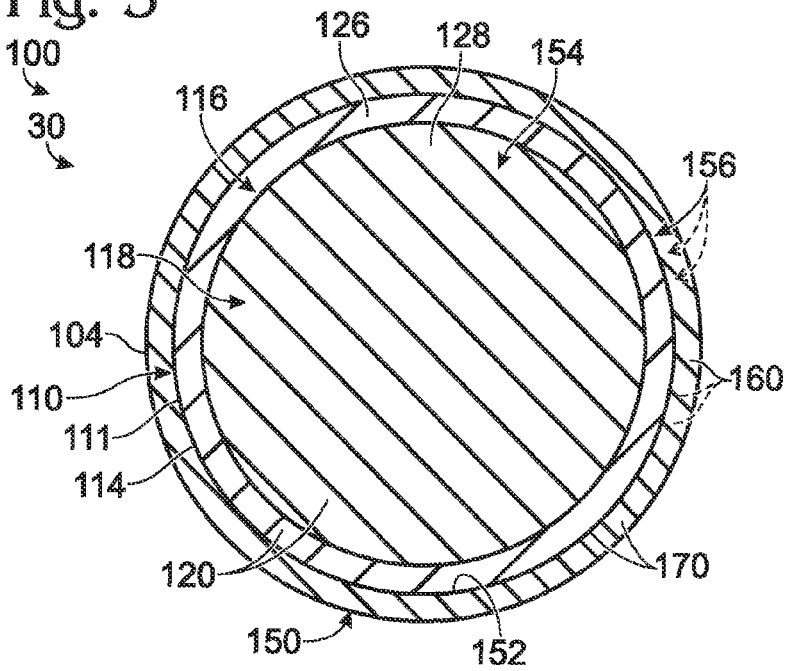
FIG. 3 is another schematic cross-sectional view of illustrative, non-exclusive examples of a projectile according to the present disclosure.

FIG. 1 is a partially fragmentary view of an illustrative, non-exclusive example of a projectile 100 according to the present disclosure, and FIGS. 2-3 are schematic cross-sectional views of illustrative, non-exclusive examples of projectile 100 according to the present disclosure. Projectile 100 also may include, be, and/or be referred to herein, as a shot pellet 30 and/or as a firearm projectile 100. Projectile 100 includes a core 110, which is formed from one or more core materials 120, and an outer coating 150, which is formed from a coating material 160 that is different from core material 120.

Projectile 100 may include and/or define any suitable shape, cross-sectional shape, and/or outer perimeter. As an illustrative, non-exclusive example, and as illustrated in FIGS. 1-3, projectile 100 may define a circular, or at least substantially circular, cross-sectional shape. Additionally or alternatively, the projectile also may define a spherical, or at least substantially spherical, shape and/or outer surface 104. When projectile 100 defines a circular cross-sectional shape and/or a spherical outer surface, a size of the projectile may be characterized by a diameter 102 thereof, as indicated in FIGS. 2-3.

While FIGS. 2-3 illustrate in solid lines a circular cross-sectional shape for projectile 100, it is within the scope of the present disclosure that the projectile may, additionally or alternatively, define a square, rectangular, trapezoidal, triangular, and/or irregular cross-sectional shape. Similarly, projectile 100 also may define any suitable outer surface, including any suitable cylindrical, cuboid, and/or irregular outer surface. Accordingly, FIGS. 2-3 additionally or alternatively may be described as schematically illustrating a projectile 100 with such a non-circular shape. When projectile 100 defines a non-spherical outer surface, the size of the projectile may be characterized by an effective diameter 102. As used herein the term "effective diameter" may refer to a diameter of a sphere that defines the same volume as a volume of projectile 100.

Illustrative, non-exclusive examples of diameters and/or effective diameters for projectiles 100 according to the present disclosure include diameters and/or effective diameters of at least 0.25 mm, at least 0.5 mm, at least 1 mm, at least 1.5 mm, at least 2 mm, at least 2.5 mm, at least 3 mm, or at least 3.5 mm. Additionally or alternatively, projectile 100 may include a diameter and/or an effective diameter of less than 15 mm, less than 12.5 mm, less than 10 mm, less than 9 mm, less than 8 mm, less than 7 mm, less than 6 mm, less than 5 mm, or less than 4 mm.

Core 110 may include and/or define any suitable cross-sectional shape and/or outer surface 114, illustrative, non-exclusive examples of which are discussed in more detail herein with reference to projectile 100. In addition, and also similar to projectile 100, core 110 also may include and/or define any suitable diameter and/or effective diameter 112, illustrative, non-exclusive examples of which also are discussed in more detail herein with reference to projectile 100. However, and as illustrated in FIG. 2, the diameter of core 110 is less than the diameter of projectile 100 due to the presence of outer coating 150 thereon.

It is within the scope of the present disclosure that projectile 100 and/or core 110 thereof may be formed in any suitable manner. As illustrative, non-exclusive examples, projectile 100 and/or core 110 may be formed by drawing (including, but not limited to, redrawing a rod or wire), casting, and/or extruding. As additional illustrative, non-exclusive examples, a shape, final shape, or finished shape of projectile 100 (and/or core 110 thereof) may be defined by heading, swaging, and/or rolling.

Core material 120 may be selected to provide a target, desired, and/or selected ballistic property for projectile 100 while, at the same time, permitting projectile 100 to meet and/or exceed environmental and/or wildlife regulations regarding the toxicity thereof. As an illustrative, non-exclusive example, core material 120 may be selected to have at least a threshold density. This may permit projectile 100 to travel a desired distance when fired from a firearm, to maintain at least a threshold velocity at a specified distance from the firearm, and/or to maintain at least a threshold impact force at the specified distance from the firearm. Illustrative, non-exclusive examples of threshold densities according to the present disclosure include threshold densities of at least 7 grams/cubic centimeter (g/cc), at least 7.25 g/cc, at least 7.5 g/cc, at least 7.75 g/cc, at least 8 g/cc, at least 8.25 g/cc, at least 8.5 g/cc, at least 8.75 g/cc, or at least 9 g/cc.

As another illustrative, non-exclusive example, core material 120 additionally or alternatively may be selected to have a hardness that is less than an upper hardness threshold and/or greater than a lower hardness threshold. This may permit firing of the projectile from a given firearm without damage to the firearm (such as to an inner surface of a barrel of a shotgun or other firearm) and/or may produce a desired level of deformation of the projectile upon being fired from the firearm. As an illustrative, non-exclusive example, and when projectile 100 is a shot pellet 30, a plurality of which are contained in a shot shell and configured to be fired from a shotgun, deformation of the plurality of shot pellets during firing of the shotgun may produce a specified and/or desired shot pattern diameter and/or shot string length at a given distance from the shotgun.

Illustrative, non-exclusive examples of upper hardness thresholds according to the present disclosure include upper hardness thresholds of less than 95 Brinell, less than 90 Brinell, less than 85 Brinell, less than 80 Brinell, less than 75 Brinell, less than 70 Brinell, less than 65 Brinell, less than 60 Brinell, less than 55 Brinell, less than 50 Brinell, less than 45 Brinell, or less than 40 Brinell. Illustrative, non-exclusive examples of lower hardness thresholds according to the present disclosure include lower hardness thresholds of greater than 15 Brinell, greater than 20 Brinell, greater than 25 Brinell, greater than 30 Brinell, greater than 35 Brinell, greater than 40 Brinell, or greater than 45 Brinell.

As an illustrative, non-exclusive example, core material 120 may include and/or be copper (or core 110 may include and/or be a copper core). Additionally or alternatively, core material 120 also may include and/or be a copper alloy, brass, bronze, zinc, tin, phosphorus, aluminum, manganese, silicon, and/or mixtures and/or alloys thereof. Additional illustrative, non-exclusive examples of core 110 and/or core material 120 are disclosed in U.S. Patent Application Publication No. 2011/0203477, the complete disclosure of which is hereby incorporated by reference.

The inclusion of copper within (and/or as) core 110 may represent an improvement in ballistic properties over several of the lead alternatives that are discussed herein. As an illustrative, non-exclusive example, a hardness of pure copper may be approximately 35 Brinell. This relatively low hardness may permit firing a projectile that includes copper from a firearm, such as a shotgun, at relatively high velocities (such as velocities in excess of 1450 feet/second or 440 meters/second) without damage to the barrel of the shotgun and/or without requiring a specialized wad and/or a specialized shot cup to provide additional protection for the barrel.

In addition, this relatively low hardness also may permit a desired amount of deformation, or flattening, of the projectiles upon being fired from the firearm. This projectile deformation may increase a spread of a plurality of projectiles that may be fired from the shotgun. Thus, and even though a density of copper is approximately 20% lower than a density of lead, copper projectiles may be designed that approach the shot pattern, shot penetration, and/or shot trail of lead projectiles, which may represent a significant improvement in ballistic performance over many lead alternatives.

Furthermore, copper also may be less expensive and/or more readily available than other lead alternatives and/or may be domestically sourced. This may permit more economical manufacture of projectiles that include copper when compared to many lead alternatives. As an illustrative, non-exclusive example, market prices for bismuth and tungsten have increased much more significantly over the past 10-20 years than market prices for copper.

When core material 120 includes copper, the copper may comprise any suitable fraction, proportion, and/or percentage of core 110. As illustrative, non-exclusive examples, the copper may comprise at least 50 weight percent (wt %), at least 55 wt %, at least 60 wt %, at least 65 wt %, at least 70 wt %, at least 75 wt %, at least 80 wt %, at least 85 wt %, at least 90 wt %, at least 95 wt %, at least 97.5 wt %, or at least 99 wt % of the core material. As additional illustrative, non-exclusive examples, the copper may comprise less than 100 wt %, less than 99 wt %, less than 98 wt %, less than 97 wt %, less than 96 wt %, less than 95 wt %, less than 92.5 wt %, less than 90 wt %, less than 87.5 wt %, less than 85 wt %, less than 82.5 wt %, or less than 80 wt % of the core material.

It is within the scope of the present disclosure that the copper may be present in any suitable portion of core 110 and/or core material 120 thereof. As an illustrative, non-exclusive example, and as illustrated in FIG. 2, core 110 may include and/or be a uniform, or at least substantially uniform, core 110 that includes a single core material 120 that defines a uniform, or at least substantially uniform, chemical composition. Thus, the single core material 120 of FIG. 1 may comprise any of the above-listed weight percentages of copper.

As another illustrative, non-exclusive example, and as illustrated in FIG. 2, core 110 may include and/or be a composite core 111. Composite core 111, which also may be referred to herein as a layered core 111, may include at least two different regions, portions, and/or layers. As an illustrative, non-exclusive example, and as illustrated in FIG. 3, composite core 111 may include at least an outer region 116 and an inner region 118, with outer region 116 surrounding and/or encapsulating inner region 118. While two regions are illustrated in FIG. 3, it is within the scope of the present disclosure that composite core 111 may include any suitable number of regions, including at least 2, at least 3, at least 4, at least 5, at least 6, at least 8, or at least 10 regions.

When core 110 is composite core 111 and includes a plurality of regions, core material 120 that defines at least one region of the plurality of regions may differ from core material 120 that defines at least one other region of the plurality of regions. As an illustrative, non-exclusive example, outer region 116 of FIG. 3 may be defined by a first, or outer, core material 126; and inner region 118 of FIG. 3 may be defined by a second, or inner, core material 128 that may be different from first core material 126.

As an illustrative, non-exclusive example, outer core material 126 may include and/or be copper, while inner core material 128 may not include copper and/or may include a different concentration, composition, amount, and/or weight percentage of copper than outer core material 126. When outer core material 126 includes copper, composite core 111 also may be referred to herein as a copper-plated core 111, as a copper-clad core 111, and/or as a copper-covered core 111. Illustrative, non-exclusive examples of the copper composition (in weight percent) of outer core material 126 are discussed herein with reference to core material 120. Illustrative, non-exclusive examples of inner core material 128 are discussed in more detail herein with reference to core material 120.

It is within the scope of the present disclosure that core material 120 (including inner core material 128 and/or outer core material 126, when present) may be, or may be considered to be, harmful, poisonous, toxic, chronically toxic, and/or acutely toxic to certain animals and/or organisms, at least under certain conditions. Additionally or alternatively, core material 120 also may be, or may be considered to be, an environmental pollutant that may be harmful, poisonous, toxic, chronically toxic, and/or acutely toxic to the environment, at least under certain conditions. As an illustrative, non-exclusive example, core material 120 may be, or may be considered to be, harmful when swallowed and/or ingested by certain animals. As another illustrative, non-exclusive example, core material 120 may be, or may be considered to be, chemically and/or biologically harmful when embedded in and/or under the skin of certain animals. As yet another illustrative, non-exclusive example, core material 120 may be, or may be considered to be, an environmental pollutant when present in certain ambient environments, such as within certain bodies of water at concentrations that are greater than a threshold magnitude.

As such, and as discussed in more detail herein with reference to outer coating 150, one or more properties of core 110 and/or outer coating 150 may be selected to permit use of projectile 100 while decreasing a potential for and/or avoiding these potentially harmful and/or polluting characteristics of core material 120. As an illustrative, non-exclusive example, a property of outer coating 150 may be selected to prevent core 110 and/or core material 120 thereof from being harmful to animals, from being an environmental pollutant, from chemically reacting, and/or from corroding. Illustrative, non-exclusive examples of properties of outer coating 150 include a thickness of the outer coating, a uniformity of the outer coating, a durability of the outer coating, a flexibility of the outer coating, an elasticity of the outer coating, and/or a chemical composition of coating material 160.

As an illustrative, non-exclusive example, and as discussed, core material 120 may include and/or be copper; and projectile 100 may include and/or be a shot pellet 30 that may be utilized in hunting waterfowl, such as ducks. Under these conditions, designing projectile 100 such that the copper is not harmful to waterfowl when ingested thereby, designing projectile 100 such that the copper within shot pellet 30 will not poison the waterfowl when embedded under the skin thereof, designing projectile 100 such that the copper within shot pellet 30 is not harmful to a scavenger that might consume waterfowl that include the copper, and/or designing projectile 100 such that the copper within shot pellet 30 will not act as an environmental pollutant may permit acceptance of, approval of, and/or use of copper as a component of shot pellet 30 and/or core material 120 thereof.

Historically, conventional wisdom has held that copper is toxic to waterfowl and/or other animals when consumed thereby. Thus, the ammunition industry has largely ignored copper as a potential component (or at least a major component) of projectiles 100 when the projectile is utilized under conditions in which the copper might be biologically and/or environmentally toxic.

However, recent studies (such as "Lead Poisoning in White Tailed Sea Eagles: Causes and Approaches to Solutions in Germany," Krone et al., pages 289-301, *Ingestion of Lead from Spent Ammunition: Implications for Wildlife and Humans*, The Peregrine Fund, Boise, Id., USA, 2009) have concluded that copper is not harmful to small animals when evaluated in light of modern environmental and/or ecological concerns and/or regulations. In addition, older research that supports this conclusion also exists (such as Bureau of Sport Fisheries and Wildlife, Patuxent Wildlife Research Center, Laurel, Md., *Bulletin of Wildlife Disease Association*, Vol. 3, October, 1967.). Thus, and at least under certain conditions, ingestion of copper may not be harmful to animals.

Despite the above observations, there still exists a concern that copper from projectiles 100 might function as an environmental pollutant, especially when the projectile is utilized to hunt waterfowl and/or when a spent projectile is deposited within a body of water subsequent to being fired from a firearm. As an illustrative, non-exclusive example, copper from a projectile that does not include outer coating 150 may be corroded within the body of water at a rate of 0.2 to 1.0 mils per year (mpy) (0.00508 to 0.0254 millimeters per year (mmpy)), thereby releasing dissolved copper, copper ions, and/or copper-containing compounds into the body of water.

With this in mind, current environmental standards (according to U.S. Fish & Wildlife Service protocol) are based upon a hypothetical body of water that has a volume of 3,048,000 liters and contains 69,000 shot pellets of #4 size (i.e., 0.130 inches or 3.3 millimeters (mm)). The environmental regulations require that a concentration of copper within the hypothetical body of water after 28 days of exposure to the shot pellets be less than a threshold copper concentration.

This threshold copper concentration may vary with the location and/or composition of the body of water and/or with the aquatic species that are present within the body of water. As an illustrative, non-exclusive example, the environmental standards may require that the concentration of copper be less than a maximum allowable species mean acute value (SMAV) concentration for an indicator species, such as *Daphnia pulicaria* (which is 2.73 parts per billion (ppb)), and the expected copper concentration within the hypothetical body of water for shot pellets that are formed from pure, or substantially pure, copper often exceeds this threshold copper concentration.

However, with projectiles 100 according to the present disclosure, one or more properties (as discussed above) of outer coating 150 may be selected to maintain a corrosion rate of copper within core material 120 below a threshold copper corrosion rate. This may permit use of copper within core material 120 without the potential for exceeding a threshold copper concentration in the hypothetical body of water that is discussed above (such as a threshold copper concentration of less than or equal to 2.73 ppb). As an illustrative, non-exclusive example, the one or more properties of outer coating 150 may be selected such that the corrosion rate of copper is less than the threshold copper corrosion rate when projectile 100 is immersed in a hypothetical body of water (or an actual aqueous solution) that includes a chemical composition that is comparable to a chemical composition of a body of water into which the projectile might be immersed and/or located during use of the projectile, while hunting with the projectile, and/or subsequent to firing the projectile from a firearm.

As another illustrative, non-exclusive example, the one or more properties of outer coating 150 may be selected such that the corrosion rate of copper within core material 120 is less than 0.001 millimeters per year (mmpy), less than 0.00075 mmpy, less than 0.0005 mmpy, less than 0.00025 mmpy, less than 0.0001 mmpy, less than 0.000075 mmpy, less than 0.00005 mmpy, less than 0.000025 mmpy, less than 0.00001 mmpy, or less than 0.0000075 mmpy. Additionally or alternatively, the one or more properties of outer coating 150 may be selected such that the corrosion rate of copper within core material 120 is at least 0.00001 mmpy, at least 0.00005 mmpy, at least 0.0001 mmpy, at least 0.0005 mmpy, at least 0.001 mmpy, or at least 0.002 mmpy.

Outer coating 150 may include and/or be any suitable structure and/or may be formed from any suitable coating material 160 that may decrease the corrosion rate of core 110 and/or core material 120 thereof. As an illustrative, non-exclusive example, outer coating 150 may define a continuous, or at least substantially continuous, outer shell 152. Outer shell 152 may define an internal volume 154 that may contain, or encapsulate, core 110.

It is within the scope of the present disclosure that outer coating 150 may be located on, may be proximal to, and/or may surround outer surface 114 of core 110 in any suitable manner. As illustrative, non-exclusive examples, the outer coating may be adhered to core 110, may be bonded to core 110, may encapsulate core 110, may surround core 110, may be chemically bonded to core 110, and/or may be chemically reacted with core 110.

It is also within the scope of the present disclosure that outer coating 150 may decrease the rate of corrosion of core 110 (and/or core material 120 thereof) in any suitable manner. As an illustrative, non-exclusive example, outer coating 150 may include and/or be an isolation layer that (at least partially or completely) fluidly and/or chemically isolates core 110 from an ambient environment that surrounds projectile 100. As another illustrative, non-exclusive example, outer coating 150 may include and/or be a passivation layer that decreases a chemical reactivity of core material 120. As yet another illustrative, non-exclusive example, outer coating 150 may include and/or be a corrosion-inhibiting layer that decreases a potential for corrosion of core material 120 and/or that decreases a corrosion rate of the core material. As another illustrative, non-exclusive example, outer coating 150 may include and/or be a hydrophobic film that decreases a surface energy of projectile 100 and/or decreases a potential for wetting of projectile 100 by water.

As more specific but still illustrative, non-exclusive examples, outer coating 150 may include a portion of core material 120 and/or may include a reaction product that includes the portion of core material 120. As an illustrative, non-exclusive example, outer coating 150 may include and/or be a copper compound, illustrative, non-exclusive examples of which include a copper oxide, a copper sulfide, a copper sulfate, a copper carbonate, and/or a copper chloride.

As another more specific but still illustrative, non-exclusive example, outer coating 150 may include and/or be a layer that covers core 110. As illustrative, non-exclusive examples, this layer may include any suitable paint, varnish, lacquer, oil, and/or wax. Additionally or alternatively, a further optional construction is to include an outer coating 150 that includes a chelating agent that is dissolved in a lacquer, varnish, paint, oil, wax, or similar coating material.

When core material 120 includes a metallic core material, such as copper, it is within the scope of the present disclosure that coating material 160, or a portion thereof, may be configured to chemically react and/or bond with core material 120. As an illustrative, non-exclusive example, coating material 160 may include and/or be the chelating agent. As another illustrative, non-exclusive example, coating material 160 may form a ligand with core material 120.

As another more specific but still illustrative, non-exclusive example, outer coating 150 and/or coating material 160 thereof may include and/or be a polymeric coating material, a metallic coating material, an organic coating material, and/or an inorganic coating material. Illustrative, non-exclusive examples of coating material 160 according to the present disclosure include one or more of an azole, a thiazole, a benzothiazole, a triazole, a benzotriazole, a tolytriazole, a methylbenzotriazole, a carboxybenzotriazole, an ethylenediaminetetraacetic acid, a dimercaprol, a porphyrin, and/or potassium sorbate. Additional illustrative, non-exclusive examples of coating material 160 include metal binding compounds. Illustrative, non-exclusive examples of metal binding compounds are disclosed in U.S. Pat. No. 7,361,279, the complete disclosure of which is hereby incorporated by reference.

As an illustrative, non-exclusive example, and when outer surface 114 of core 110 includes copper, outer coating 150 may be formed by soaking core 110 in an azole solution and subsequently drying the core to produce a core 110 that has an azole coating. Thus, outer coating 150 may include and/or be the azole coating.

It is within the scope of the present disclosure that outer coating 150 may include a plurality of coating materials 160, illustrative, non-exclusive examples of which are discussed herein. Additionally or alternatively, it is also within the scope of the present disclosure that outer coating 150 may include and/or be a plurality of layers 156. This may include a plurality of layers that are distinct from one another and/or layered on top of one another to form an overall, composite, and/or layered outer coating 150. When outer coating 150 includes a plurality of layers 156, two or more of the plurality of layers 156 may have the same composition. Additionally or alternatively, at least a first portion of the plurality of layers may include a different chemical composition and/or may serve a different function than a second, and/or subsequent, portion of the plurality of layers. The first and second (and/or subsequent) portions of the plurality of layers 156 each may include and/or be one or more complete layers of the plurality of layers 156. Illustrative, non-exclusive examples of the composition and/or function of each layer of the plurality of layers 156 are disclosed herein with reference to outer coatings 150 and/or coating materials 160.

As an illustrative, non-exclusive example, and subsequent to formation of the above-discussed azole coating, core 110 also may be coated with a secondary coating material. Illustrative, non-exclusive examples of the secondary coating material include an organic masking substance, such as a paint, a varnish, a lacquer, an oil, and/or a wax. Thus, the azole coating may function as a first, or inner, layer 156 of outer coating 150, and the secondary coating material may function as a second, or outer, layer 156 of outer coating 150.

It is also within the scope of the present disclosure that projectile 100 and/or outer coating 150 thereof further may include an adhesion layer 170. As an illustrative, non-exclusive example, adhesion layer 170 may be formed on and/or from outer surface 114 of core 110 and may be selected to increase an adhesion between core 110 and outer coating 150. As another illustrative, non-exclusive example, adhesion layer 170 may include and/or be one or more layers 156 of outer coating 150 and may be configured to increase an adhesion between core 110 and another layer 156 of the outer coating. As yet another illustrative, non-exclusive example, adhesion layer 170 also may be present between two layers 156 of outer coating 150 and may be configured to increase an adhesion therebetween.

As an illustrative, non-exclusive example, and when core material 120 includes a metallic core material 120, adhesion layer 170 may include and/or be a chelating agent. Additionally or alternatively, adhesion layer 170 may be selected to form a ligand with the core material.

Outer coating 150 may include and/or define a coating thickness 158 (as illustrated schematically in FIG. 2), which also may be referred to herein as an average coating thickness 158 and/or a mean coating thickness 158. It is within the scope of the present disclosure that coating thickness 158 may have any suitable magnitude. As an illustrative, non-exclusive example, the coating thickness may be at least 0.000001 mm, at least 0.000005 mm, at least 0.00001 mm, at least 0.00005 mm, at least 0.0001 mm, at least 0.0005 mm, at least 0.001 mm, at least 0.005 mm, at least 0.01 mm, at least 0.05 mm, or at least 0.1 mm. As another illustrative, non-exclusive example, the coating thickness may be less than 0.3 mm, less than 0.275 mm, less than 0.25 mm, less than 0.225 mm, less than 0.2 mm, less than 0.175 mm, less than 0.15 mm, less than 0.125 mm, less than 0.1 mm, less than 0.075 mm, less than 0.05 mm, less than 0.025 mm, less than 0.01 mm, less than 0.0075 mm, less than 0.005 mm, less than 0.0025 mm, less than 0.001 mm, less than 0.0005 mm, or less than 0.0001 mm.

Figure 4:
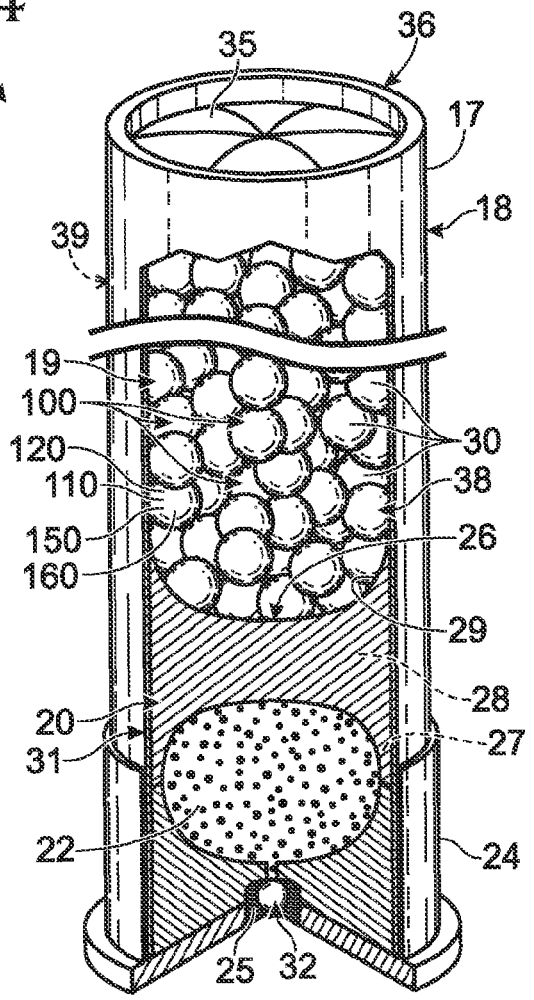
FIG. 4 is a schematic representation of illustrative, non-exclusive examples of a shot shell that may include a plurality of projectiles according to the present disclosure.

FIG. 4 is a schematic representation of illustrative, non-exclusive examples of a shot shell 10 that may include a plurality of projectiles 100 according to the present disclosure in the form of a plurality of shot pellets 30. These projectiles may include and/or be projectiles 100 of FIGS. 1-3. Similarly, references herein to shot pellets 30, or projectiles 100, being fired from a shotgun or other firearm may refer to the projectiles being fired from a shot shell 10 that is loaded within the shotgun or other firearm.

Shot shell 10 is shown including a head, or head portion, 24, a shot shell case, or casing, 17, and a mouth region 36. Shot shell 10 further includes an ignition device 32, such as primer, or priming mixture, 25, which is located behind a propellant, or powder, 22, which also may be referred to as the charge 22 of the shot shell and/or as the propellant charge 22 of the shot shell. Propellant 22 and primer 25 are located behind a partition 31, namely, a wad 20, which serves to segregate the propellant and the primer from the shot shell's payload 38. Wad 20 may define and/or be described as defining a shot cup 26, which refers to a portion of the wad that generally faces toward the mouth region 36 and which typically is contacted by at least a portion of the plurality of projectiles 100. Powder 22 additionally or alternatively may be referred to as smokeless powder 22 or gun powder 22. Wad 20 additionally or alternatively may be referred to as a shot wad 20, and it may take a variety of suitable shapes and sizes.

Any suitable size, shape, material, and/or construction of wad 20 may be used, including but not limited to conventional wads that have been used with lead shot, without departing from the scope of the present disclosure.

Casing 17 and head 24 additionally or alternatively may be referred to as forming a housing 18 of the shot shell. As indicated in FIG. 4, housing 18 (and/or casing 17) may be described as defining an internal chamber, internal compartment, and/or enclosed volume 19 of the shot shell. When the shot shell is assembled, at least propellant 22, wad 20, and payload 38 are inserted into the internal compartment, such as through mouth region 36. After insertion of these components into the internal compartment, mouth region 36 is sealed or otherwise closed, such as via any suitable closure 35. As an illustrative, non-exclusive example, the region of the casing distal head 24 may be folded, crimped, or otherwise used to close mouth region 36.

Payload 38 additionally or alternatively may be referred to as a shot charge, or shot load, 38. Payload 38 typically will include a plurality of shot pellets 30. The region of shot shell 10, casing 17, and/or wad 20 that contains payload 38 may be referred to as the payload region 39 thereof.

Wad 20 defines a pellet-facing surface 29 that extends and/or faces generally toward mouth region 36 and away from head 24 (when the wad is positioned properly within an assembled shot shell). Wad 20 may include at least one gas seal, or gas seal region, 27, and at least one deformable region 28, between the payload region 39 and the propellant 22. Gas seal region 27 is configured to engage the inner surface of the shotgun's chamber and barrel to restrict the passage of gasses, which are produced when the shot shell is fired (i.e., when the charge is ignited), along the shotgun's barrel. By doing so, the gasses propel the wad, and the payload of shot pellets 30 contained therein, from the chamber and along and out of the shotgun's barrel. Deformable region 28 is designed to crumple, collapse, or otherwise non-elastically deform in response to the setback, or firing, forces that are generated when the shot shell is fired and the combustion of the propellant rapidly urges the wad and payload from being stationary to travelling down the barrel of the shotgun at high speeds.

A shot shell may include as few as a single shot pellet 30, which perhaps more appropriately may be referred to as a shot slug, and as many as dozens or hundreds of individual shot pellets 30. The number of shot pellets 30 in any particular shot shell will be defined by such factors as the size and geometry of the shot pellets, the size and shape of the shell's casing and/or wad, the available volume in the casing to be filled by shot pellets 30, etc. For example, a double ought (00) buckshot shell typically contains nine shot pellets having diameters of approximately 0.3 inches (0.762 cm), while shot shells that are intended for use in hunting birds, and especially smaller birds, tend to contain many more shot pellets.

Shot shell 10 and its components have been schematically illustrated in FIG. 4 and are not intended to require a specific shape, size, or quantity of the components thereof. The length and diameter of the overall shot shell 10 and its housing 18, the amount of primer 25 and propellant 22, the shape, size, and configuration of wad 20, the type, shape, size, and/or number of shot pellets 30, etc. all may vary within the scope of the present disclosure.

As discussed, shot shell 10 is designed and/or configured to be placed within a firearm, such as a shotgun, and to fire shot charge 38 therefrom. As an illustrative, non-exclusive example, a firing pin of the firearm may strike primer 25, which may ignite propellant charge 22. Ignition of propellant charge 22 may produce gasses that may expand and provide a motive force to propel shot charge 38 from the firearm (or a barrel thereof). The rapid expansion of gasses within the firearm may deform at least a portion of the shot pellets due to the rapid acceleration of the shot pellets and the large forces that may be associated therewith.

Subsequent to being propelled from the firearm, at least a portion of the shot charge may strike a target, which may include any suitable man-made target, an animal, a body of water, and/or the ground. This further may deform at least a portion of the shot pellets.

With this in mind, outer coating 150 may be selected, designed, and/or configured to remain at least partially intact despite the deformation that may be associated with shot pellets 30 being fired from the firearm and/or striking the target. This may include selecting a composition of coating material 160 and/or a thickness of the coating material such that the outer coating remains at least partially intact subsequent to the deformation. Additionally or alternatively, the outer coating also may be selected, designed, and/or configured such that it does not react with other components of shot shell 10, such as propellant 22, primer 25, wad 20, and/or casing 17.

As discussed, core material 120 of projectile 100 may include and/or be copper, and the target may include a body of water (or at least a portion of the shot pellets may enter the body of water subsequent to (or without) striking the target). Under these conditions, it is also within the scope of the present disclosure that the thickness of the outer coating and/or the composition of the coating material may be selected to maintain the corrosion rate of the copper within projectile 100 below a threshold copper corrosion rate when the projectile is located within the body of water. Illustrative, non-exclusive examples of the threshold copper corrosion rate are discussed in more detail herein.

As an illustrative, non-exclusive example, projectiles 100 according to the present disclosure were formed by soaking copper cores 110 in aqueous azole solutions and by coating the copper cores with a wax. Subsequently, these projectiles were subjected to 28-day corrosion tests. The results of these tests indicate a 10- to 50-fold decrease in the corrosion rate of copper cores 110 of projectiles 100 when compared to uncoated copper projectiles (i.e. a sample of the copper cores 110 that did not include an outer coating 150). In addition, the obtained corrosion rates were, in many cases, sufficiently low to permit use of projectiles 100 according to the present disclosure in shot shells 10 without exceeding applicable environmental standards for copper concentrations within bodies of water that might receive projectiles 100 subsequent to the projectiles being fired from a firearm.

Figure 5:
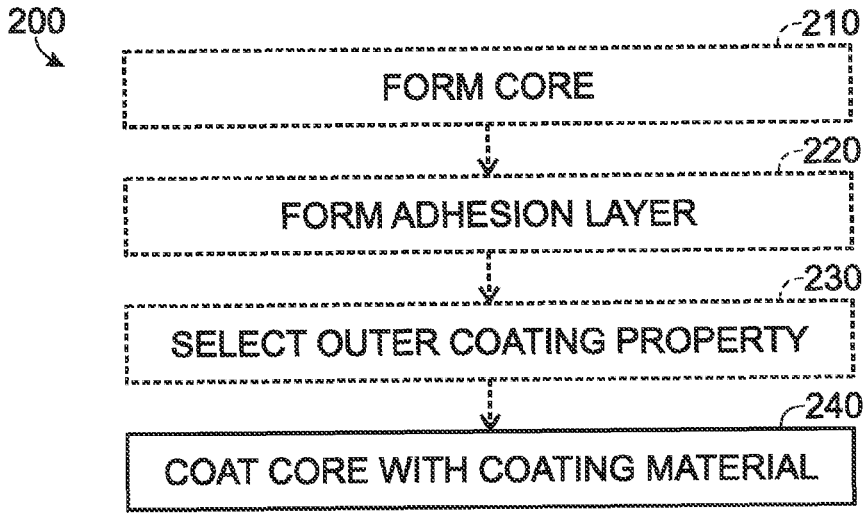
FIG. 5 is a flowchart depicting methods for forming a projectile according to the present disclosure.

FIG. 5 is a flowchart depicting illustrative, non-exclusive examples of methods 200 of forming a projectile according to the present disclosure. Methods 200 may include forming a core at 210, forming an adhesion layer at 220, and/or selecting an outer coating property at 230, and methods 200 include coating the core with a coating material at 240.

Forming the core at 210 may include forming the core in any suitable manner. As illustrative, non-exclusive examples, the forming at 210 may include drawing, casting, and/or extruding the core material to form the core. As additional illustrative, non-exclusive examples, the forming at 210 also may include heading, swaging, and/or rolling the core material to define a final shape of the core. As a more specific but still illustrative, non-exclusive example, the core material may include a metallic core material that is supplied as a wire and/or as a rod, and the forming at 210 may include redrawing the wire and/or the rod to a diameter that corresponds to a desired diameter of the core. Additional illustrative, non-exclusive examples of the core material are disclosed herein with reference to core material 120 of FIGS. 1-4.

It is within the scope of the present disclosure that the forming at 210 may include forming the core to any suitable shape, diameter, and/or effective diameter. Illustrative, non-exclusive examples of shapes of the core are disclosed herein with reference to core 110 of FIGS. 1-4. Illustrative, non-exclusive examples of diameters and/or effective diameters for the core also are disclosed herein with reference to core 110 of FIGS. 1-4.

As discussed herein, the core may be a composite core that includes a plurality of regions, including at least an inner region and an outer region that surrounds and/or encapsulates the inner region. When the core is a composite core, the forming at 210 may include forming the inner region and subsequently forming the outer region and/or subsequently encapsulating the inner region with the outer region. Illustrative, non-exclusive examples of the inner region and the outer region are disclosed herein with reference to composite core 111 of FIG. 3.

Forming the adhesion layer at 220 may include forming any suitable adhesion layer in any suitable manner. As an illustrative, non-exclusive example, the adhesion layer may be selected, formulated, and/or configured to increase an adhesion between the core material (or the core) and the coating material (or the outer coating). As more specific but still illustrative, non-exclusive examples, the adhesion layer may be formed from a chelating agent and/or may form a ligand with the core material. Illustrative, non-exclusive examples of adhesion layers, chelating agents, and/or materials that may form ligands with the core material are disclosed herein.

Selecting the outer coating property at 230 may include selecting any suitable property of the outer coating based, at least in part, on any suitable criteria. As illustrative, non-exclusive examples, the selecting at 230 may include selecting a thickness of the outer coating and/or selecting a composition (or chemical composition) of the coating material. As another illustrative, non-exclusive example, and when the core material includes, or is, copper, the selecting at 230 may include selecting such that a corrosion rate of the copper is below a threshold copper corrosion rate. Under these conditions, method 200 further may include determining the corrosion rate of copper within the projectile. This may include determining the corrosion rate of copper when the projectile is immersed in an aqueous solution that includes, or defines, a chemical composition that is comparable to a chemical composition of a body of water into which the projectile is immersed, or is likely to be immersed, during use thereof.

Illustrative, non-exclusive examples of threshold copper corrosion rates are disclosed herein with reference to core 110 of FIGS. 1-4. Illustrative, non-exclusive examples of the outer coating, the coating material, and/or the composition (or chemical composition) of the coating material are disclosed herein with reference to outer coating 150 and/or coating material 160 of FIGS. 1-4.

Coating the core with the coating material at 240 may include coating the core with the coating material in any suitable manner to define the outer coating and/or to fog it the projectile. As illustrative, non-exclusive examples, the coating at 240 may include immersing the core within the coating material and/or immersing the core within a solution (or an aqueous solution) that includes the coating material. As additional illustrative, non-exclusive examples, the coating at 240 also may include spraying the coating material over the core, agitating and/or rolling the core in the presence of the coating material, encapsulating the core in the coating material, adhering the coating material to the core, reacting the coating material with the core, and/or pouring the coating material over the core.

It is within the scope of the present disclosure that the coating at 240 may include coating the core with a single coating material to define a single outer coating. Additionally or alternatively, it is also within the scope of the present disclosure that the coating at 240 may include (sequentially) coating the core with a plurality of the same or different coating materials and/or forming a plurality of (the same or different) outer coatings and/or coating layers on the core. The coating at 240 may include coating such that the outer coating defines any suitable coating thickness on the core and/or within the projectile. Illustrative, non-exclusive examples of the coating thickness are disclosed herein.

After forming projectiles 100, at least one projectile 100, and typically a plurality of projectiles 100, may be loaded into a shot shell, such as into a payload region thereof, to produce a shot shell 10 according to the present disclosure.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems according to the present disclosure are presented in the following enumerated paragraphs.

A1. A projectile, comprising:

a core that is formed from a core material; and an outer coating that is formed from a coating material that is different from the core material and is selected to decrease a corrosion rate of the core material.

A2. The projectile of paragraph A1, wherein the projectile defines a circular, or at least substantially circular, cross-sectional shape.

A3. The projectile of any of paragraphs A1-A2, wherein the projectile defines a spherical, or at least substantially spherical, outer surface.

A4. The projectile of any of paragraphs A1-A3, wherein a diameter, or an effective diameter, of the projectile is at least one of:

(i) at least 0.25 mm, at least 0.5 mm, at least 1 mm, at least 1.5 mm, at least 2 mm, at least 2.5 mm, at least 3 mm, or at least 3.5 mm; and (ii) less than 15 mm, less than 12.5 mm, less than 10 mm, less than 9 mm, less than 8 mm, less than 7 mm, less than 6 mm, less than 5 mm, or less than 4 mm.

A5. The projectile of any of paragraphs A1-A4, wherein the projectile is a shot pellet that is sized to be placed within a payload region of a shot shell.

A6. The projectile of any of paragraphs A1-A5, wherein the core defines a circular, or at least substantially circular, cross-sectional shape.

A7. The projectile of any of paragraphs A1-A6, wherein the core defines a spherical, or at least substantially spherical, outer surface.

A8. The projectile of any of paragraphs A1-A7, wherein a diameter, or an effective diameter, of the core is at least one of:

(i) at least 0.1 mm, at least 0.25 mm, at least 0.5 mm, at least 1 mm, at least 1.5 mm, at least 2 mm, at least 2.5 mm, at least 3 mm, or at least 3.5 mm; and (ii) less than 15 mm, less than 12.5 mm, less than 10 mm, less than 9 mm, less than 8 mm, less than 7 mm, less than 6 mm, less than 5 mm, or less than 4 mm.

A9. The projectile of any of paragraphs A1-A8, wherein the core material includes copper.

A10. The projectile of paragraph A9, wherein copper comprises at least one of:

(i) at least 50 weight percent (wt %), at least 55 wt %, at least 60 wt %, at least 65 wt %, at least 70 wt %, at least 75 wt %, at least 80 wt %, at least 85 wt %, at least 90 wt %, at least 95 wt %, at least 97.5 wt %, or at least 99 wt % of the core material; and (ii) less than 100 wt %, less than 99 wt %, less than 98 wt %, less than 97 wt %, less than 96 wt %, less than 95 wt %, less than 92.5 wt %, less than 90 wt %, less than 87.5 wt %, less than 85 wt %, less than 82.5 wt %, or less than 80 wt % of the core material.

A11. The projectile of any of paragraphs A9-A10, wherein at least one of a thickness of the outer coating and a composition of the coating material is selected to maintain a corrosion rate of copper within the core material below a threshold copper corrosion rate.

A12. The projectile of paragraph A11, wherein the threshold copper corrosion rate is at least one of:

(i) at least 0.00001 millimeters per year (mmpy), at least 0.00005 mmpy, at least 0.0001 mmpy, at least 0.0005 mmpy, at least 0.001 mmpy, or at least 0.002 mmpy; and (ii) less than 0.001 mmpy, less than 0.00075 mmpy, less than 0.0005 mmpy, less than 0.00025 mmpy, less than 0.0001 mmpy, less than 0.000075 mmpy, less than 0.00005 mmpy, less than 0.000025 mmpy, less than 0.00001 mmpy, or less than 0.0000075 mmpy.

A13. The projectile of any of paragraphs A11-A12, wherein the corrosion rate of the copper is determined when the projectile is immersed in an aqueous solution that includes a chemical composition that is comparable to a chemical composition of a body of water into which the projectile is immersed during use thereof.

A14. The projectile of any of paragraphs A9-A13, wherein the core is a composite core that includes an inner region and an outer region that encapsulates the inner region, and further wherein the copper comprises the outer region of the core, and optionally wherein the composite core is a copper-plated core.

A15. The projectile of any of paragraphs A1-A14, wherein the core material includes at least one of a copper alloy, brass, bronze, zinc, tin, phosphorus, aluminum, manganese, and silicon.

A16. The projectile of any of paragraphs A1-A15, wherein the outer coating defines an outer shell that defines an internal volume that contains the core.

A17. The projectile of any of paragraphs A1-A16, wherein at least a portion of the outer coating is at least one of adhered to, bonded to, and chemically bonded to the core.

A18. The projectile of any of paragraphs A1-A17, wherein the outer coating includes, or is, an isolation layer that fluidly and chemically isolates the core material from an ambient environment that surrounds the projectile.

A19. The projectile of any of paragraphs A1-A18, wherein the outer coating includes, or is, a passivation layer that decreases a chemical reactivity of the core material.

A20. The projectile of any of paragraphs A1-A19, wherein the outer coating includes, or is, a corrosion-inhibiting layer that decreases a potential for corrosion of the core material.

A21. The projectile of any of paragraphs A1-A20, wherein the outer coating includes, or is, a hydrophobic film.

A22. The projectile of any of paragraphs A1-A21, wherein the outer coating includes a plurality of layers, and optionally wherein the plurality of layers includes at least two, at least three, at least four, or at least five of an/the isolation layer, a/the passivation layer, a/the corrosion inhibiting layer, a/the hydrophobic film, and an adhesion layer.

A23. The projectile of any of paragraphs A1-A22, wherein the projectile further includes an/the adhesion layer that increases an adhesion between the core and the outer coating.

A24. The projectile of paragraph A23, wherein the core material is a metallic core material, and further wherein the adhesion layer forms a ligand with the core material, and optionally wherein the adhesion layer includes a chelating agent.

A25. The projectile of any of paragraphs A1-A24, wherein the outer coating includes at least one of a copper oxide, a copper sulfide, a copper carbonate, a copper chloride, and a copper sulfate.

A26. The projectile of any of paragraphs A1-A25, wherein the outer coating includes at least one of a paint, a varnish, a lacquer, an oil, and a wax.

A27. The projectile of any of paragraphs A1-A26, wherein the core material is a metallic core material, optionally wherein the coating material forms a ligand with the core material, and further optionally wherein the coating material is a chelating agent.

A28. The projectile of any of paragraphs A1-A27, wherein the coating material is at least one of a polymeric coating material, a metallic coating material, an organic coating material, and an inorganic coating material.

A29. The projectile of any of paragraphs A1-A28, wherein the coating material includes at least one of an azole, a thiazole, a benzothiazole, a triazole, a benzotriazole, a tolytriazole, a methylbenzotriazole, a carboxybenzotriazole, an ethylenediaminetetraacetic acid, a dimercaprol, a porphyrin, and potassium sorbate.

A30. The projectile of any of paragraphs A1-A29, wherein the outer coating defines a coating thickness, and further wherein the coating thickness is at least one of:

(i) at least 0.000001 mm, at least 0.000005 mm, at least 0.00001 mm, at least 0.00005 mm, at least 0.0001 mm, at least 0.0005 mm, at least 0.001 mm, at least 0.005 mm, at least 0.01 mm, at least 0.05 mm, or at least 0.1 mm; and (ii) less than 0.3 mm, less than 0.275 mm, less than 0.25 mm, less than 0.225 mm, less than 0.2 mm, less than 0.175 mm, less than 0.15 mm, less than 0.125 mm, less than 0.1 mm, less than 0.075 mm, less than 0.05 mm, less than 0.025 mm, less than 0.01 mm, less than 0.0075 mm, less than 0.005 mm, less than 0.0025 mm, less than 0.001 mm, less than 0.0005 mm, or less than 0.0001 mm.

A31. The projectile of any of paragraphs A1-A30 formed using the method of any of paragraphs B1-B27.

A32. A shot shell, comprising:

a cylindrical casing that defines a head portion, a mouth region, and an enclosed volume;

a primer that is operatively attached to the head portion and defines a portion of the enclosed volume;

a propellant charge that is located within the enclosed volume proximal to the primer, wherein the propellant charge is in thermal communication with the primer, and further wherein the primer is configured to selectively ignite the propellant charge;

a shot charge that is located within the enclosed volume proximal to the mouth region, wherein the shot charge includes the projectile of any of paragraphs A1-A31, and optionally a plurality of the projectiles of any of paragraphs A1-A31; and a wad that is located within the enclosed volume and separates the shot charge from the propellant charge.

A33. The shot shell of paragraph A32, wherein the shot shell is configured to be placed within a firearm, wherein a firing pin of the firearm is configured to strike the primer to selectively ignite the propellant charge and propel the shot charge from a barrel of the firearm, wherein the shot charge is configured to strike a target, and optionally wherein at least one of a/the thickness of the outer coating and a/the composition of the coating material is selected such that the outer coating remains at least partially intact, and optionally at least substantially intact, and further optionally completely intact, subsequent to the projectile of the shot charge striking the target.

A34. The shot shell of paragraph A33, wherein the target includes a body of water, wherein the core material includes copper, and further wherein the at least one of the thickness of the outer coating and the composition of the coating material is selected to maintain a corrosion rate of copper within the core material below a/the threshold copper corrosion rate.

A35. The shot shell of paragraph A34, wherein the threshold copper corrosion rate is at least one of:

(i) at least 0.00001 millimeters per year (mmpy), at least 0.00005 mmpy, at least 0.0001 mmpy, at least 0.0005 mmpy, at least 0.001 mmpy, or at least 0.002 mmpy; and (ii) less than 0.001 mmpy, less than 0.00075 mmpy, less than 0.0005 mmpy, less than 0.00025 mmpy, less than 0.0001 mmpy, less than 0.000075 mmpy, less than 0.00005 mmpy, less than 0.000025 mmpy, less than 0.00001 mmpy, or less than 0.0000075 mmpy.

B1. A method of forming a projectile, the method comprising:

coating a core, which is defined by a core material, with a coating material to define an outer coating that surrounds the core and form the projectile.

B2. The method of paragraph B1, wherein the coating includes immersing the core within the coating material.

B3. The method of paragraph B2, wherein the immersing includes immersing the core in a solution, and optionally an aqueous solution, that includes the coating material.

B4. The method of any of paragraphs B1-B3, wherein the coating includes spraying the coating material over the core.

B5. The method of any of paragraphs B1-B4, wherein the coating includes agitating the core in the presence of the coating material.

B6. The method of any of paragraphs B1-B5, wherein the coating includes encapsulating the core in the coating material.

B7. The method of any of paragraphs B1-B6, wherein the coating includes adhering the coating material to the core.

B8. The method of any of paragraphs B1-B7, wherein the coating includes reacting the core with the coating material.

B9. The method of any of paragraphs B1-B8, wherein, prior to the coating, the method further includes forming the core.

B10. The method of paragraph B9, wherein the forming includes at least one of drawing, casting, and extruding the core material to form the core.

B11. The method of any of paragraphs B9-B10, wherein the forming includes at least one of heading, swaging, and rolling the core material to define a final shape of the core.

B12. The method of any of paragraphs B9-B11, wherein the core material includes a metallic core material, wherein, prior to the forming, the core material defines a wire, and further wherein the forming includes redrawing the wire to a diameter that corresponds to a desired diameter of the core.

B13. The method of any of paragraphs B9-B12, wherein the forming includes forming the core material to a diameter, or an effective diameter, of at least one of:

(i) at least 0.1 mm, at least 0.25 mm, at least 0.5 mm, at least 1 mm, at least 1.5 mm, at least 2 mm, at least 2.5 mm, at least 3 mm, or at least 3.5 mm; and (ii) less than 15 mm, less than 12.5 mm, less than 10 mm, less than 9 mm, less than 8 mm, less than 7 mm, less than 6 mm, less than 5 mm, or less than 4 mm.

B14. The method of any of paragraphs B9-B13, wherein the core is a composite core that includes an inner region and an outer region that encapsulates the inner region, and further wherein the forming includes forming the inner region and subsequently encapsulating the inner region with the outer region to define the core.

B15. The method of paragraph B14, wherein the outer region comprises copper.

B16. The method of any of paragraphs B14-B15, wherein the inner region comprises at least one of a copper alloy, brass, bronze, zinc, tin, arsenic, phosphorus, aluminum, manganese, and silicon.

B17. The method of any of paragraphs B1-B16, wherein, prior to the coating, the method further includes forming an adhesion layer on the core, wherein the adhesion layer is selected to increase an adhesion between the core material and the coating material, and optionally wherein the adhesion layer forms a ligand with the core material.

B18. The method of any of paragraphs B1-B17, wherein the core material includes copper, and optionally wherein the copper comprises at least one of:

(i) at least 50 weight percent (wt %), at least 55 wt %, at least 60 wt %, at least 65 wt %, at least 70 wt %, at least 75 wt %, at least 80 wt %, at least 85 wt %, at least 90 wt %, at least 95 wt %, at least 97.5 wt %, or at least 99 wt % of the core material; and (ii) less than 100 wt %, less than 99 wt %, less than 98 wt %, less than 97 wt %, less than 96 wt %, less than 95 wt %, less than 92.5 wt %, less than 90 wt %, less than 87.5 wt %, less than 85 wt %, less than 82.5 wt %, or less than 80 wt % of the core material.

B19. The method of paragraph B18, wherein the method further includes selecting at least one of a thickness of the outer coating and a composition of the coating material such that a corrosion rate of copper within the core material is below a threshold copper corrosion rate, optionally wherein the threshold copper corrosion rate is at least one of:

(i) at least 0.00001 millimeters per year (mmpy), at least 0.00005 mmpy, at least 0.0001 mmpy, at least 0.0005 mmpy, at least 0.001 mmpy, or at least 0.002 mmpy; and (ii) less than 0.001 mmpy, less than 0.00075 mmpy, less than 0.0005 mmpy, less than 0.00025 mmpy, less than 0.0001 mmpy, less than 0.000075 mmpy, less than 0.00005 mmpy, less than 0.000025 mmpy, less than 0.00001 mmpy, or less than 0.0000075 mmpy.

B20. The method of paragraph B19, wherein the selecting includes determining the corrosion rate of the copper when the projectile is immersed in an aqueous solution that includes a chemical composition that is comparable to a chemical composition of a body of water into which the projectile is immersed during use thereof B21. The method of any of paragraphs B1-B20, wherein the coating includes coating the core with a plurality of outer coatings, and optionally with a plurality of outer coatings having different compositions.

B22. The method of any of paragraphs B1-B21, wherein the outer coating includes at least one of a copper oxide, a copper sulfide, a copper carbonate, a copper chloride, and a copper sulfate.

B23. The method of any of paragraphs B1-B22, wherein the outer coating includes at least one of a paint, a varnish, a lacquer, an oil, and a wax.

B24. The method of any of paragraphs B1-B23, wherein the core material is a metallic core material, optionally wherein the coating material forms a ligand with the core material, and further optionally wherein the coating material is a chelating agent.

B25. The method of any of paragraphs B1-B24, wherein the coating material is at least one of a polymeric coating material, a metallic coating material, an organic coating material, and an inorganic coating material.

B26. The method of any of paragraphs B1-B25, wherein the coating material includes at least one of an azole, a thiazole, a benzothiazole, a triazole, a benzotriazole, a tolytriazole, a methylbenzotriazole, a carboxybenzotriazole, an ethylenediaminetetraacetic acid, a dimercaprol, a porphyrin, and potassium sorbate.

B27. The method of any of paragraphs B1-B26, wherein the coating includes coating to a coating thickness of at least one of:

(i) at least 0.000001 mm, at least 0.000005 mm, at least 0.00001 mm, at least 0.00005 mm, at least 0.0001 mm, at least 0.0005 mm, at least 0.001 mm, at least 0.005 mm, at least 0.01 mm, at least 0.05 mm, or at least 0.1 mm; and (ii) less than 0.3 mm, less than 0.275 mm, less than 0.25 mm, less than 0.225 mm, less than 0.2 mm, less than 0.175 mm, less than 0.15 mm, less than 0.125 mm, less than 0.1 mm, less than 0.075 mm, less than 0.05 mm, less than 0.025 mm, less than 0.01 mm, less than 0.0075 mm, less than 0.005 mm, less than 0.0025 mm, less than 0.001 mm, less than 0.0005 mm, or less than 0.0001 mm.

INDUSTRIAL APPLICABILITY

The systems and methods disclosed herein are applicable to the firearm and ammunition fields.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A shot shell, comprising:

a cylindrical casing that defines a head portion, a mouth region, and an enclosed volume;

a primer that is operatively attached to the head portion and defines a portion of the enclosed volume;

a propellant charge that is located within the enclosed volume proximal to the primer, wherein the propellant charge is in thermal communication with the primer, and further wherein the primer is configured to selectively ignite the propellant charge;

a shot charge that is located within the enclosed volume proximal to the mouth region, wherein the shot charge includes a plurality of projectiles that each includes:

a core that is formed from a core material, wherein the core material includes at least 50 wt % copper;

(ii) a corrosion-resistant outer coating that is formed from a coating material that is different from the core material; and (iii) an adhesion layer that increases an adhesion between the core and the outer coating, wherein the adhesion layer forms a ligand with the core material; and a wad that is located within the enclosed volume and separates the shot charge from the propellant charge.

2. The shot shell of claim 1, wherein the shot shell is configured to be placed within a firearm, wherein a firing pin of the firearm is configured to strike the primer to selectively ignite the propellant charge and propel the shot charge from a barrel of the firearm, wherein the shot charge is configured to strike a target, and further wherein at least one of a thickness of the outer coating and a composition of the coating material is selected such that the outer coating remains at least substantially intact subsequent to the projectile of the shot charge striking the target.

3. The shot shell of claim 2, wherein the target includes a body of water, and further wherein, when the plurality of projectiles is immersed within the body of water, a corrosion rate of copper within the core material is below a threshold copper corrosion rate of 0.00075 mmpy.

4. The shot shell of claim 1, wherein a diameter of each of the plurality of projectiles is at least 1 mm and less than 10 mm.

5. The shot shell of claim 1, wherein each of the plurality of projectiles is a shot pellet that is sized to be placed within the enclosed volume of the shot shell.

6. The shot shell of claim 1, wherein a corrosion rate, in water, of copper within the core material is below a threshold copper corrosion rate of 0.00075 mmpy when the plurality of projectiles are placed in the water.

7. The shot shell of claim 6, wherein the corrosion rate of the copper is determined when each of the plurality of projectiles is immersed in an aqueous solution that includes a chemical composition that is comparable to a chemical composition of a body of water into which the plurality of projectiles are immersed subsequent to being fired from a firearm.

8. The shot shell of claim 1, wherein the core of each of the plurality of projectiles is a composite core that includes an inner region and an outer region that encapsulates the inner region, and further wherein the copper comprises the outer region of the core.

9. The shot shell of claim 8, wherein the inner region of each of the plurality of projectiles includes at least one of a copper alloy, brass, bronze, zinc, tin, phosphorus, aluminum, manganese, and silicon.

10. The shot shell of claim 1, wherein the outer coating of each of the plurality of projectiles defines an outer shell that defines an internal volume that contains the core.

11. The shot shell of claim 1, wherein the outer coating of each of the plurality of projectiles includes an isolation layer that fluidly and chemically isolates the core material from an ambient environment that surrounds the projectile.

12. The shot shell of claim 1, wherein the outer coating of each of the plurality of projectiles includes a passivation layer that decreases a chemical reactivity of the core material.

13. The shot shell of claim 1, wherein the outer coating of each of the plurality of projectiles includes a corrosion-inhibiting layer that decreases a potential for corrosion of the core material.

14. The shot shell of claim 1, wherein the outer coating of each of the plurality of projectiles includes a hydrophobic film.

15. The shot shell of claim 1, wherein the outer coating of each of the plurality of projectiles includes a plurality of layers.

16. The shot shell of claim 1, wherein the outer coating of each of the plurality of projectiles includes at least one of a copper oxide, a copper sulfide, a copper sulfate, a copper carbonate, and a copper chloride.

17. The shot shell of claim 1, wherein the outer coating of each of the plurality of projectiles includes at least one of a paint, a varnish, a lacquer, an oil, and a wax.

18. The shot shell of claim 1, wherein the coating material of each of the plurality of projectiles includes at least one of an azole, a thiazole, a benzothiazole, a triazole, a benzotriazole, a tolytriazole, a methylbenzotriazole, a carboxybenzotriazole, an ethylenediaminetetraacetic acid, a dimercaprol, a porphyrin, and potassium sorbate.

19. The shot shell of claim 1, wherein the outer coating of each of the plurality of projectiles defines a coating thickness of less than 0.05 mm.

20. The shot shell of claim 1, wherein the shot charge is the plurality of projectiles.

21. The shot shell of claim 1, wherein the adhesion layer is formed on an outer surface of the core.

22. The shot shell of claim 1, wherein the adhesion layer is formed from an outer surface of the core.

23. The shot shell of claim 1, wherein the outer coating includes a plurality of layers, and wherein the adhesion layer forms at least one of the plurality of layers.

24. A shot shell, comprising:

a cylindrical casing that defines a head portion, a mouth region, and an enclosed volume;

a primer that is operatively attached to the head portion and defines a portion of the enclosed volume;

a propellant charge that is located within the enclosed volume proximal to the primer, wherein the propellant charge is in thermal communication with the primer, and further wherein the primer is configured to selectively ignite the propellant charge;

a shot charge that is located within the enclosed volume proximal to the mouth region, wherein the shot charge includes a plurality of projectiles that each includes:

(i) a core that is formed from a core material, wherein the core material includes at least 50 wt % copper; and (ii) a corrosion-resistant outer coating that is formed from a coating material that is different from the core material, wherein the outer coating includes an adhesion layer that increases adhesion between the core and the outer coating, and further wherein the adhesion layer forms a ligand with the core material; and a wad that is located within the enclosed volume and separates the shot charge from the propellant charge.

25. The shot shell of claim 24, wherein the shot shell is configured to be placed within a firearm, wherein a firing pill of the firearm is configured to strike the primer to selectively ignite the propellant charge and propel the shot charge from a barrel of the firearm, wherein the shot charge is configured to strike a target, and further wherein at least one of a thickness of the outer coating and a composition of the coating material is selected such that the outer coating remains at least substantially intact subsequent to the projectile of the shot charge striking the target.

26. The shot shell of claim 25, wherein the target includes a body of water, and further wherein, when the plurality of projectiles is immersed within the body of water, a corrosion rate of copper within the core material is below a threshold copper corrosion rate of 0.00075 mmpy.

27. The shot shell of claim 24, wherein a corrosion rate, in water, of copper within the core material is below a threshold copper corrosion rate of 0.00075 mmpy when the plurality of projectiles are placed in the water.

28. The shot shell of claim 24, wherein the adhesion layer is formed on an outer surface of the core.

29. The shot shell of claim 24, wherein the adhesion layer is formed from an outer surface of the core.

30. The shot shell of claim 24, wherein the outer coating includes a plurality of layers, and wherein the adhesion layer forms at least one of the plurality of layers.

* * * * *

UNITED STATES PATENT AND TRADEMARK OFFICE

CERTIFICATE OF CORRECTION

PATENT NO. : 9,115,961 B2
APPLICATION NO. : 13/943625
DATED : August 25, 2015
INVENTOR(S) : Darryl D. Amick It is certified that error appears in the above-identified patent and that said Letters Patent is hereby corrected as shown below:

Claims

Column 22, Line 62, Claim 25, delete “pill” and insert --pin-- therefor.

Signed and Sealed this
Second Day of February, 2016

Michelle K. Lee

Michelle K. Lee
*Director of the United States Patent and Trademark Office*